US008596512B2

(12) United States Patent
Zhou et al.

(10) Patent No.: US 8,596,512 B2
(45) Date of Patent: Dec. 3, 2013

(54) CLAMPING MECHANISM FOR AN ELECTRIC HAMMER

(75) Inventors: Hongtao Zhou, Nanjing (CN); Gan Wei, Nanjing (CN)

(73) Assignee: Chervon Limited, Hong Kong (HK)

( * ) Notice: Subject to any disclaimer, the term of this patent is extended or adjusted under 35 U.S.C. 154(b) by 390 days.

(21) Appl. No.: 12/971,784

(22) Filed: Dec. 17, 2010

(65) Prior Publication Data

US 2011/0155778 A1 Jun. 30, 2011

(30) Foreign Application Priority Data

Dec. 31, 2009 (CN) ..... 2009 1 0264782

(51) Int. Cl.
*B25C 1/06* (2006.01)
*B25D 11/04* (2006.01)

(52) U.S. Cl.
USPC ..... 227/147; 227/119; 227/140; 227/144; 227/149; 81/44; 81/454; 81/455; 81/463

(58) Field of Classification Search
USPC ..... 227/119, 140, 144, 147, 149; 81/44, 81/454–455, 463–464; 269/229, 237, 3, 6; 279/71, 74, 81–82
See application file for complete search history.

(56) References Cited

U.S. PATENT DOCUMENTS

| | | | | |
|---|---|---|---|---|
| 870,142 | A * | 11/1907 | Wahlstrom | 279/69 |
| 4,594,036 | A * | 6/1986 | Hogenhout | 408/240 |
| 5,002,134 | A * | 3/1991 | Yamada | 173/94 |
| 2007/0131076 | A1 * | 6/2007 | Yasheng | 83/699.21 |

FOREIGN PATENT DOCUMENTS

GB 2030485 A * 4/1980

* cited by examiner

*Primary Examiner* — Michelle Lopez
(74) *Attorney, Agent, or Firm* — Greenberg Traurig, LLP

(57) ABSTRACT

An electric hammer includes a striking device having a clamping mechanism. The clamping mechanism includes a clamping element, a sliding element, a first biasing device and a second biasing device. The sliding element is provided with a guide portion in which the clamping element is slidable between a first position where the clamping element is closed and a second position where the clamping element is opened. The biasing force generated by the first biasing device is smaller than that of the second biasing device when the clamping element is in the opened position.

20 Claims, 11 Drawing Sheets

CLAMPING MECHANISM FOR AN ELECTRIC HAMMER

RELATED APPLICATION INFORMATION

This application claims the benefit of CN 200910264782.9, filed on Dec. 31, 2009, the disclosure of which is incorporated herein by reference in its entirety.

BACKGROUND

The subject disclosure generally relates to electric hammers, and more particularly, to an electric hammer with a clamping mechanism for striking a nail or other component, also called an electric hammer or a nail gun.

Electric hammers or nail guns are commonly used tools in the decoration or fitment fields. An exemplary known electric hammer, disclosed in the Chinese Patent Application No. 200820161342.1, comprises a body portion and a nozzle portion connected to the body portion. The nozzle portion is generally formed by a hollowed and cylinder-shaped sliding element with a hole bored thereon for accommodating a magnet therein. The magnet is engaged in the hole to attract a nail placed within the striking device so as to clamp the nail. However, the disadvantages of such an electric hammer are: due to the fact that the magnet is arranged at one side of the sliding element, the magnet cannot be used to make the nail achieve a position at the center of the sliding element and, as such, the nail is not positionable parallel to the central line of the sliding element (i.e., the attracted nail is skew); and the magnet cannot be used to clamp nonmagnetic materials, such as a tenon or a copper nail.

SUMMARY

To overcome the existing defects in the prior art, the subject application discloses an electric hammer wherein a nail or other component can be clamped firmly within the striking device to thereby better facilitate operation thereof by a user.

More particularly, an electric hammer is disclosed that is simply operable and which provides good visibility and a compact structure. To this end, the electric hammer comprises a striking device including a clamping mechanism, wherein the clamping mechanism comprises a clamping element, a sliding element, a first biasing means, and a second biasing means, wherein the sliding element is provided with a guide portion in which the clamping element is slidable between a first position relative to the guide portion, in which the clamping elements are closed, and a second position relative to the guide portion, in which the clamping elements are opened, and wherein the biasing force generated by the first biasing means is smaller than that generated by the second biasing means so as to prevent the clamping element from closing again when the clamping element is in the open position.

The first biasing means is used for biasing the sliding element toward the direction of the striking element striking a component. The clamping mechanism comprises a connecting piece and the second biasing means acts on the connecting piece towards the direction of the striking element striking component so as to bias the clamping element.

The electric hammer may further comprise an impact assembly including an impact wheel, wherein the impact wheel contacts with a stricken portion of the striking element, and the first biasing means and said second biasing means are located between the striking element and the impact wheel.

The electric hammer may further comprise a motor and a transmission mechanism, wherein the motor defines an axis, the transmission mechanism converts the rotation motion of the motor to the impact motion for the striking element through the impact assembly, and the impact wheel defines a central axis, and wherein the axis of the motor is generally perpendicular to the central axis of the impact wheel.

The sliding element may be arranged with the guide portion on at least two surfaces thereof and the clamping element may comprise a driving portion, wherein the driving portion is mounted in the guide portion and moveable along the guide portion. The clamping mechanism may comprises four clamping elements including the driving portion and the sliding element is arranged on its four surfaces with the guide portion wherein the driving portion is mounted in the guide portion to be moveable along the guide portion.

The driving portion may include slots symmetrical with each other and having a polygonal line shape. Such an arrangement would be beneficial to decrease the sliding stroke of the sliding element so as to enable the overall structure to be more compact.

The driving portion may be mounted removably on the clamping element and/or the driving portion with the clamping elements being integrally configured.

The clamping element may comprises a clamping jaw, a spring, a magnet, a screw, and/or a chuck.

A releasing area is formed when the clamping element is located in the open position, wherein the striking element can pass through the releasing area and the clamping mechanism may comprise a protective element which can pass through the releasing area.

The clamping mechanism may comprise a third biasing means biasing the protective element toward the direction of the workpiece to be processed.

The clamping elements can be interlocked and, by so doing, it will be beneficial for the elements to open at the same time and close at the same time.

The clamping mechanism may comprise a locking mechanism including at least a projection and a spanner wherein the clamping element is in the open position when the projection is locked with the spanner and the protective element is exposed from the sliding element when the other projection is locked with the spanner.

The sliding element may be arranged with a sheath wherein a toggle-switch is provided to engage with the sheath so as to enable the sheath to move along with the toggle-switch. The user can thus press the sheath or the toggle-switch to cause the clamping element to open.

The sheath and/or the sliding element may be made from a transparent plastic so as to allow the user to observe the specific position of the striking element.

The sliding element and/or the sheath may be arranged with a groove so as to enhance the visibility of the component.

The electric hammer so arranged can be easy used by a user to place and clamp a nail or other component in the cavity. Moreover, the user will not have to worry about the nail or other component being nailed askew.

BRIEF DESCRIPTION OF THE DRAWINGS

Preferred embodiments of the subject electric hammer will be described hereinafter with reference to the accompanying drawings, wherein.

DESCRIPTION

Figure 1:
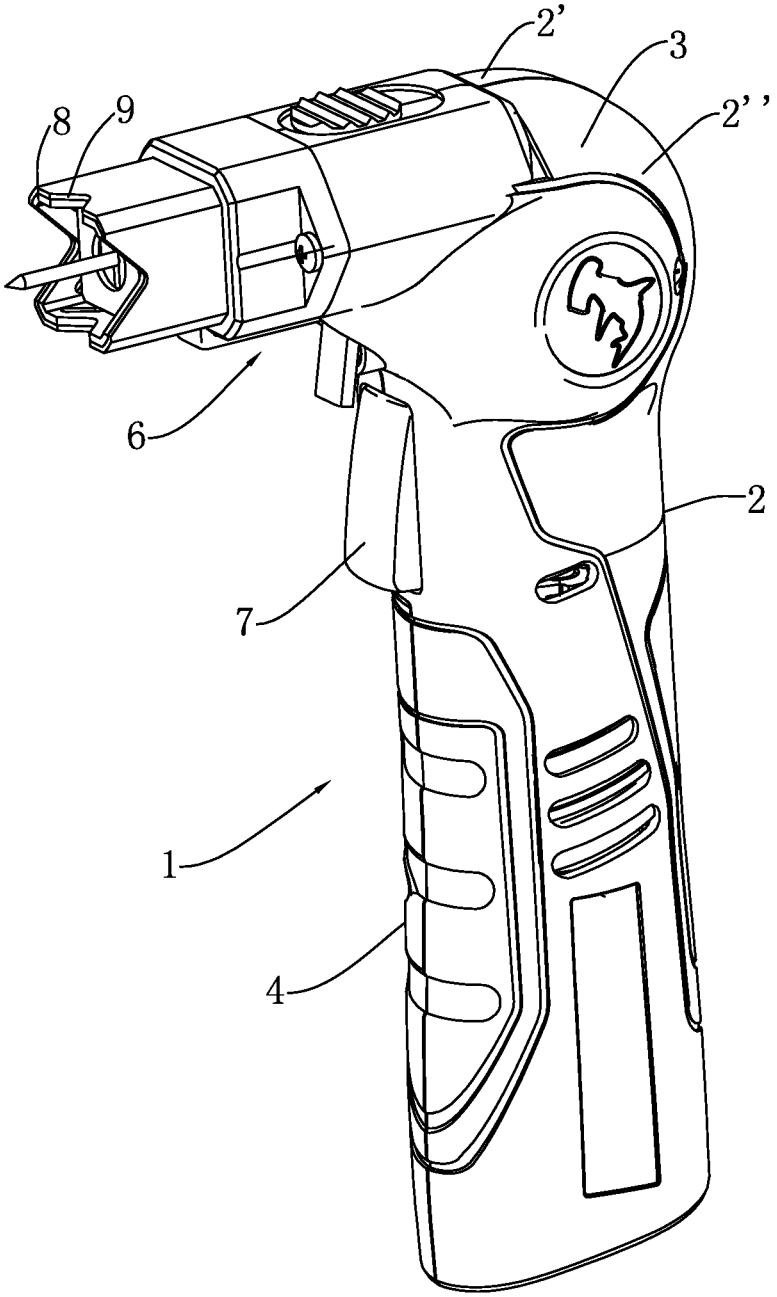
FIG. 1 is a three-dimensional schematic view of an exemplary electric hammer present constructed according to aspects of invention.
Figure 2:
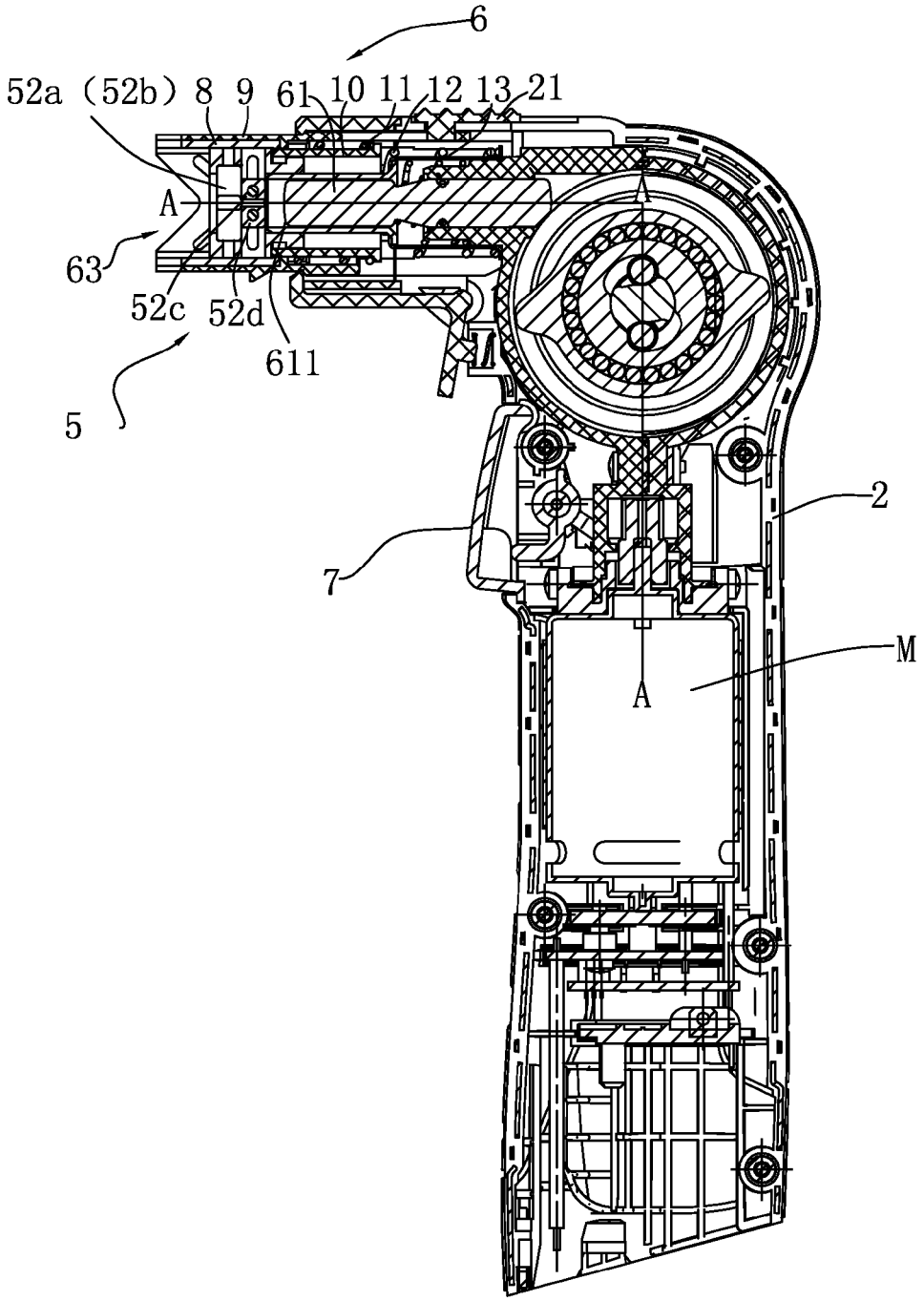
FIG. 2 is a cross-sectional view of the electric hammer as shown in FIG. 1 taken along a combination surface of the two half-housings.

As shown in FIGS. 1 and 2, an exemplary electric hammer 1 comprises a housing 2 having a motor M disposed therein and a striking device 6. The housing 2 is constituted by a left half housing 2' and a right half housing 2". A generally perpendicular grip portion 4 is formed on a main body of the housing 2. An upper portion of the housing 2 comprises a head assembly 3 which includes a transmission mechanism and a striking device 6 which generally protrudes forward from the head assembly.

In the illustrated, exemplary embodiment, the electric hammer 1 comprises a battery pack (not shown) for powering the motor M. Nevertheless, the way of supplying power or the motor M is not restricted to the use of a DC power supply and may be equally be a source of AC power. A switch 7 is arranged on the housing 2 for controlling the motor M. The striking device 6 comprises a striking rod 61 mounted in the housing 2 through a restoring spring and is provided for striking a nail or the like. The striking rod 61 is disposed substantially horizontal as illustrated and is moved linearly in a reciprocating manner within the striking device 6. During operation, the striking end 611 of the striking element 61 acts with its end surface on components such as fastening pieces like nails and tenons or objects like bricks. The striking device 6 further comprises a receiving cavity 63 having an inner diameter larger than that of the normal nails or other components. As a result, nails of all kinds of dimension and other components may be placed into the receiving cavity 63.

Figure 3:
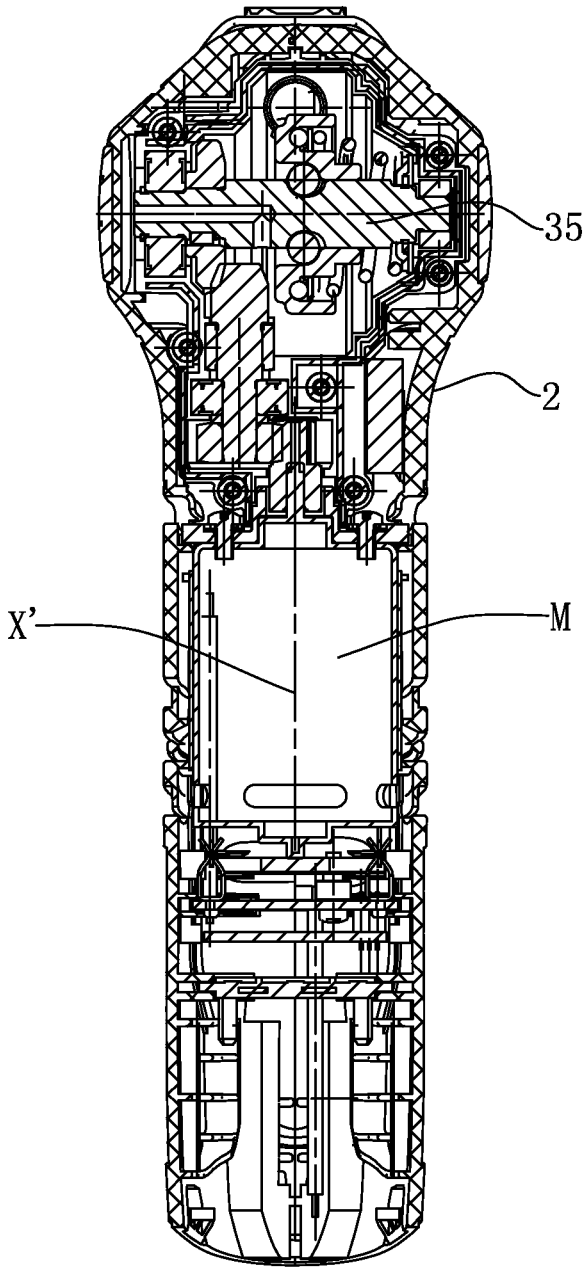
FIG. 3 is a cross-sectional view of the electric hammer as shown in FIG. 1 taken along the direction perpendicular to the combination surface of the two half-housings.
Figure 4:
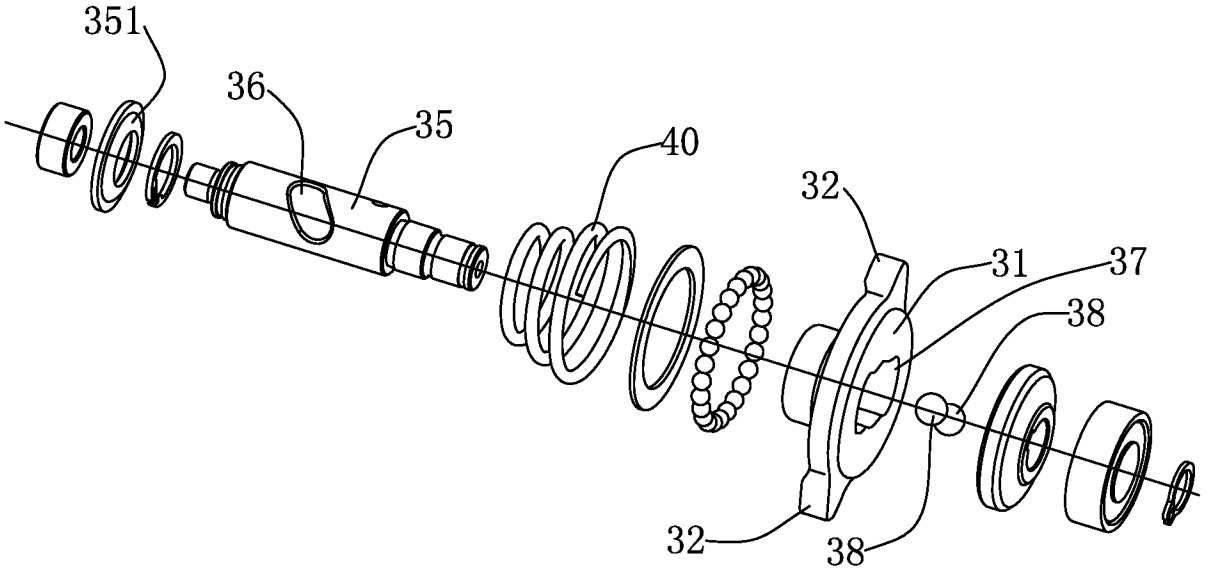
FIG. 4 is a partial exploded view of an exemplary transmission mechanism of the electric hammer of FIG. 1.

As shown in FIGS. 3-4, a rotation-linear movement transmission mechanism is arranged in the housing 2 for converting the rotational motions of the motor M into linear impact motions of the striking element 61. The motor M is mounted vertically in the housing 2 as illustrated with a upward motor shaft X' connected with a multi-stage gear transmission mechanism including a bevel gear. In this way, the rotation power of the motor 2 is transmitted to the rotating shaft 35 which is mounted on the upper portion of the housing 2 by the bearings on both its ends. The central axis of the rotating shaft 35 is substantially perpendicular to the axis of the motor. A pair of inclined slots 36 are formed on the rotating shaft 35, each of which is "V" shaped and opens backwardly. An impact wheel 31 is mounted on the rotation shaft 35 so that the central axis of the impact wheel is also substantially perpendicular to that of the motor. The impact wheel 31 is substantially a hollowed cylinder comprising a pair of arcuate guiding slots 37 which are formed on its inner wall and opposite to the two inclined slots 36 respectively. The open direction of each arcuate guiding slot 37 is reversed to that of each "V" shaped inclined slot 36. The inclined slots 36 and the guiding slots 37 are both formed as half-circular recesses. A pair of steel balls 38 are arranged movably in two chambers formed by the inclined slots 36 and guiding slots 37. Thus, the impact wheel 31 can be driven to rotate through the steel balls 38 pressing the guiding slots 36 when the rotating shaft 35 rotates. The impact wheel 31 is provided on its outer circumferential surface with a pair of projections 32 which are opposed to each other along the diametrical direction. When the switch 7 is triggered, the motor M is switched on to drive the rotating shaft 35 to rotate through the multi-stage gear transmission mechanism, and then the impact wheel 31 is driven by the rotating shaft 35 to rotate via the steel balls 38.

As shown in FIG. 4, an energy storing spring 40 is mounted between the impact wheel 31 and the rotating shaft 35 in a manner that one end of the energy storing spring 40 abuts to a shoulder 351 of the rotating shaft 35 and the other end thereof abuts to the impact wheel 31. Under the axial force of the energy storing spring 40 acting upon the shoulder 351 and the impact wheel 31, the impact wheel 31 is in a first axial position relative to the rotating shaft 35. In the first axial position, the impact wheel 31 rotates circumferentially under the combined action of the rotating shaft 35 and the steel balls 38. When the impact wheel 31 rotates to a certain position where the projections 32 may contact with the striking element 61, the resistance force caused thereby may cause the impact wheel 31 to stop rotating temporarily and compel the impact wheel 31 to move from the first axial position to a second axial position by compressing the energy storing spring 40 gradually. In the second position, the projections 32 of the impact wheel 31 pass over the striking element 61 and the braking is eliminated. Then, the energy storing spring 40 begins to release its elastic potential energy. By the rebound force of the energy storing spring 40, the impact wheel 31 is pressed back to its first position quickly, and is rotated at a higher speed than that of the rotating shaft 35 under the cooperation of the inclined slots 36, the guiding slots 37 and the steel balls 38. As a result, the stricken end 612 of the striking rod 61 is impacted by the projections 32 of the impact wheel 31 to move at a high speed in a linear direction away from the projections 32 and the striking rod 61 strikes the head of the nail quickly. After the first striking action is finished, the impact wheel 31 is continuously driven to rotate to be stopped by the striking rod 61 and then enters into succeeding cycles, which will be achieved in the same manner.

Figure 5:
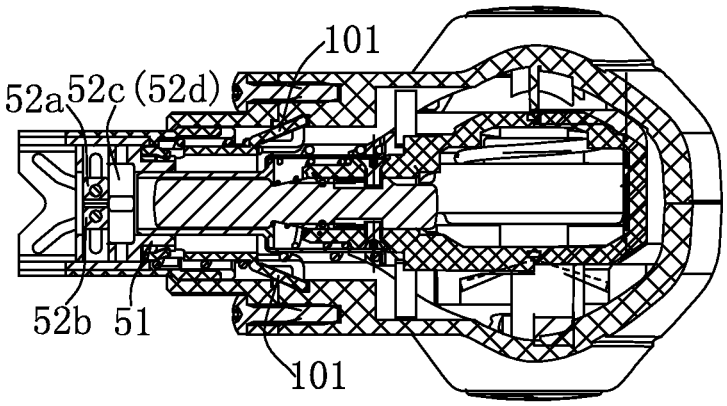
FIG. 5 is a cross-sectional view of the electric hammer of FIG. 2 taken along the axis line A-A.
Figure 6:
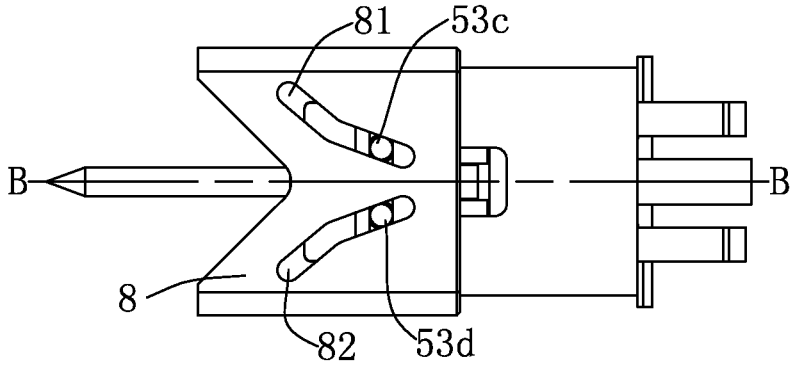
FIG. 6 is a partial enlarged view of an exemplary clamping mechanism of the electric hammer as shown in FIG. 1, wherein the clamping element is in the closed position.
Figure 7:
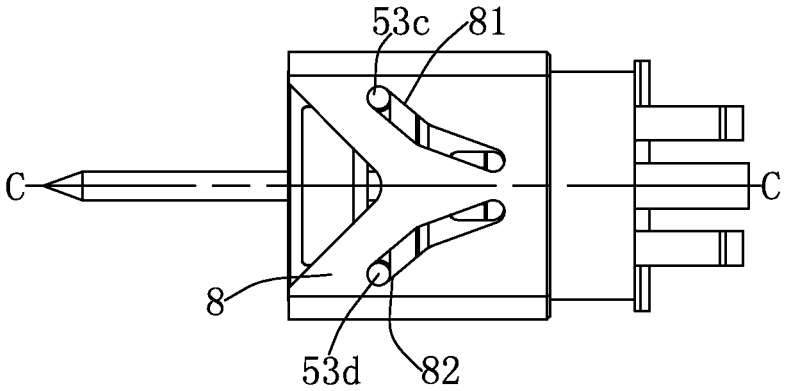
FIG. 7 is a partial enlarged view of the clamping mechanism of the electric hammer as shown in FIG. 1, wherein the clamping element is in the completely opened position.
Figure 8:
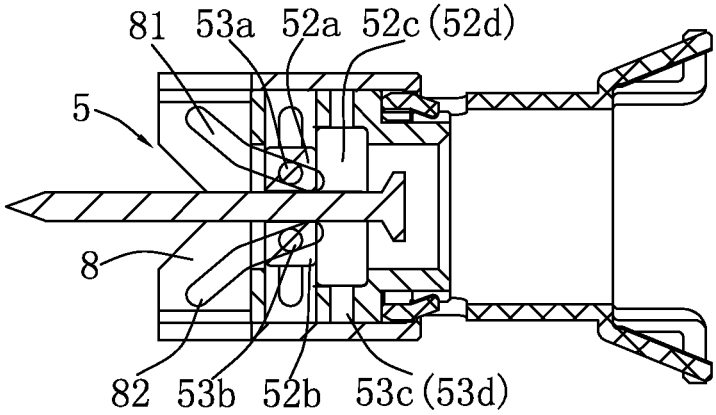
FIG. 8 is a cross-sectional view of the clamping mechanism as shown in FIG. 6 taken along the axis line B-B.
Figure 9:
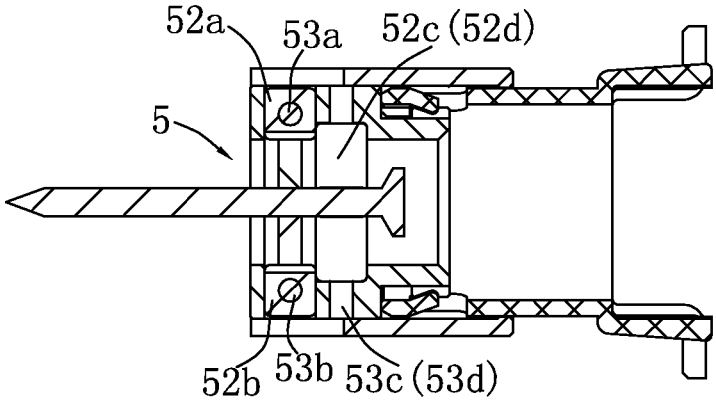
FIG. 9 is a cross-sectional view of the clamping mechanism in FIG. 7 taken along the axis line C-C.

During the striking of nails or other components in the above manner, the nails are placed into the cavity 63 by the user firstly, then the electric hammer is positioned to make a nail abut to the workpiece. At this time, the switch is pressed. As a result, the striking end 611 of the striking element 61 acts on the nail periodically. In this case, if the nail or other component is not clamped firmly or the clamping is loose, it is easy to be stricken askew. Referring to FIGS. 2, 5 and 9, the striking device 6 further comprises a clamping mechanism 5 for clamping the nail or other component firmly in front of the striking element 61. Due to this arrangement, the user does not need to worry about striking the nail askew and the working efficiency of the device is improved greatly. The detailed structure of the clamping mechanism 5 will be specified as follows. The clamping elements 52*a*, 52*b*, 52*c* and 52*d* are mounted in the body 51 of the clamping mechanism 5 and may be operated between a first position, namely the closed position of the clamping elements, and a second position, namely the completely opened position of the clamping elements. In the first position, as shown in FIGS. 6 and 8, the clamping elements 52*a*, 52*b* are engaged with each other and the clamping elements 52*c*, 52*d* are also engaged with each other, which forms a clamping area and the nail or other component can be kept therein. In the second position, as shown in FIGS. 7 and 9, the clamping elements 52*a*, 52*b* are disengaged from each other and the clamping elements 52*c*, 52*d* are also disengaged from each other. As a result, an area of release is formed, and then the striking element can continue to strike the nail by passing through the area of release until the nail is nailed into the workpiece completely. When the clamping elements are in the opened position, the nail or other component may be placed in the cavity 63 and then the clamping elements are closed so as to hold the nail or other component in the clamping area. Each of the clamping elements is provided with a groove for engaging with the arc-shape of the stricken portion of the nail to increase the contact area between the clamping elements and the stricken portion of the nail or other component and thus obtain a better clamping effect. Moreover, because the clamping elements may be adjusted, the nail or other component with different sizes can be held independently by the clamping elements. When the clamping elements are opened, the nail or other component is released from the groove.

It will be appreciated, however, that the above clamping elements may also be substituted by a clamping jaw, a spring, a magnet, a screw or a chuck or any one of combinations thereof for retaining the components.

As shown in FIGS. 6-9, preferably, the sliding element 8 is configured to be a hollow rectangular solid, the front, the back, the upper and the lower surfaces of which are provided with the guiding portions respectively. In general, the guide portions may also be only arranged on two surfaces opposed to each other. The guide portion of each surface is provided with two inclined slots 81 and 82 symmetrical to each other. Only the inclined groove in the front surface of the sliding element is shown in FIG. 6. The inclined slots in the other three surfaces are same as the one in the front surface. The inclined slots 81 and 82 may be formed integrally so as to form a "V" shaped groove. Furthermore, the inclined slots 81 and 82 are not linear slots but nonlinear slots. By doing so, the stroke of the sliding element 8 is decreased and the overall structure may be made more compact. The nonlinear slots comprise arc-shaped slots or slots formed with two or more lines with different slopes, etc. The driving portions 53*a* and 53*b* of the two clamping elements pass through the clamping elements 52*a* and 52*b* respectively and both ends of each driving portion are mounted in the corresponding inclined slots 81 and 82 in the upper and lower surfaces of the sliding element 8. The other two driving portions 53*c* and 53*d* pass through the clamping elements 52*c* and 52*d* and both ends of each driving portion are mounted in the corresponding inclined slots 81 and 82 in the front and the back surfaces of the sliding element 8. Accordingly, the four driving portions form an interlocking structure. When the clamping elements are in the first position, namely in the closed position, the four clamping elements clamp the nail tightly. In this case, both ends of the driving portion 53*a* are respectively located at the first ends of the corresponding slots 81 in the upper and the lower surfaces of the sliding element 8; both ends of the driving portion 53*b* are respectively located at the first ends of the corresponding slots 82 in the upper and the bottom surfaces of the sliding element 8; both ends of the driving portion 53*c* are respectively located at the first ends of the corresponding slots 81 in the front and the back surfaces of the sliding element 8; both ends of the driving portion 53*d* are respectively located at the first ends of the corresponding slots 82 in the front and the back surfaces of the sliding element 8. Thus, the four driving portions can move together relative to the respective slots. As shown in FIGS. 7 and 9, when the clamping elements are in the second position, namely in the completely opened position, the four clamping elements are disengaged with each other. At this time, both ends of the driving portion 53*a* are respectively located in the second ends of the corresponding inclined slots 81*a* in the upper and the lower surfaces of the sliding element 8; the two ends of each of the other three driving portions are also respectively located in the second ends of the corresponding inclined slots in the corresponding two surfaces of the sliding element. As a result, the striking element 61 may pass through therein and continue to strike the nail until the nail is fastened into the workpiece completely. It can be understood that the driving portions may also be configured to be an integral structure with the clamping elements.

Upon assembly, first of all, each of the clamping elements is placed into the body 51 of the clamping mechanism, then each of the driving portions passes through their respective clamping element, and a sheath 9 is mounted on the outer surface of the sliding element 8 to prevent the driving portions from coming off the sliding element 8 and then dropping out of the electric hammer. The body 51 is connected to one end of a ferrule 10 which serves as a connecting piece and moves together with the ferrule 10. It can be understood that the driving portions and the clamping elements may also be configured to be an integral structure.

Figure 10:
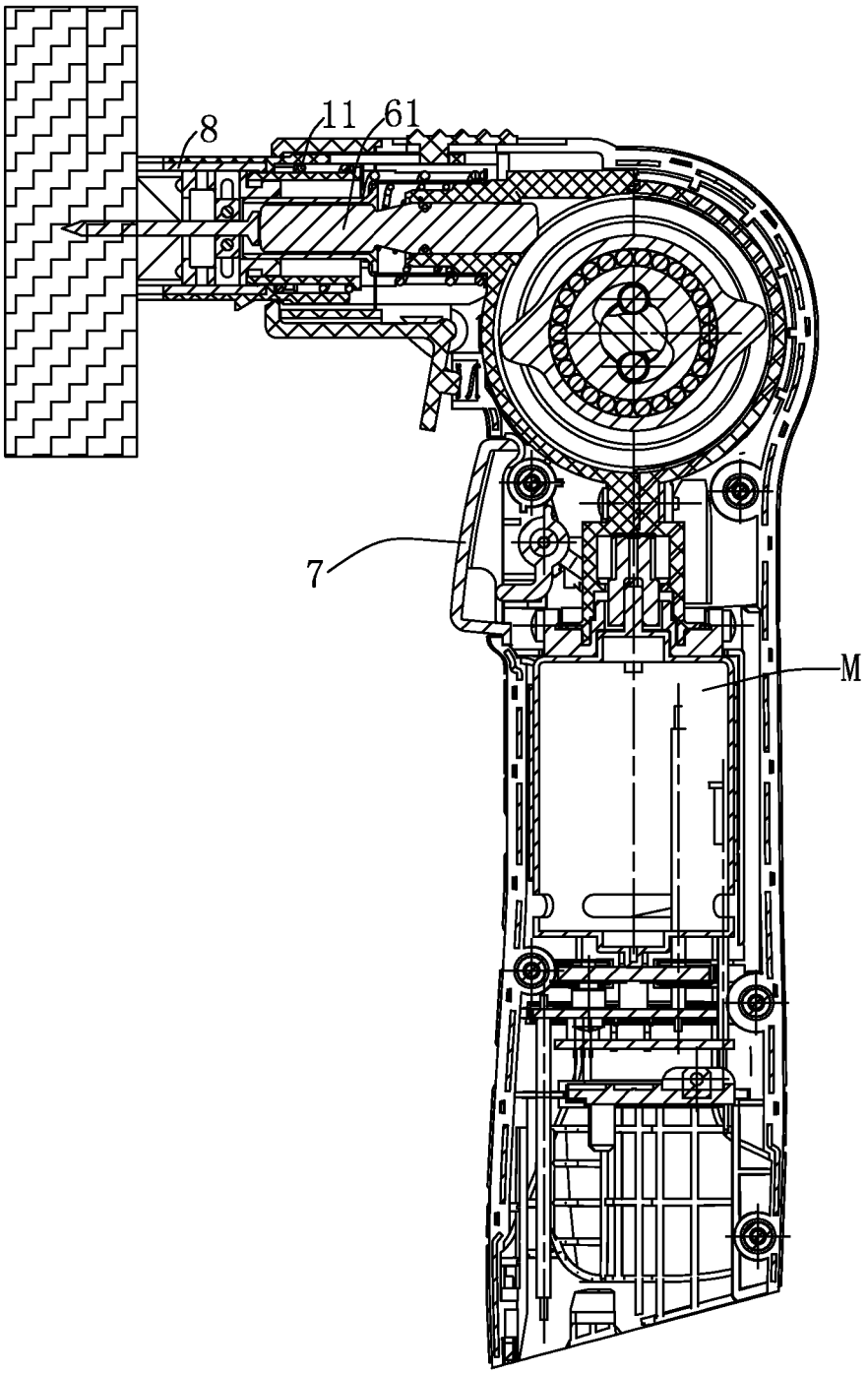
FIG. 10 is a schematic view illustrating a nail clamped within the clamping mechanism and a sliding element of the electric hammer contacting exactly with the workpiece with the clamping element being in the opened position.
Figure 11:
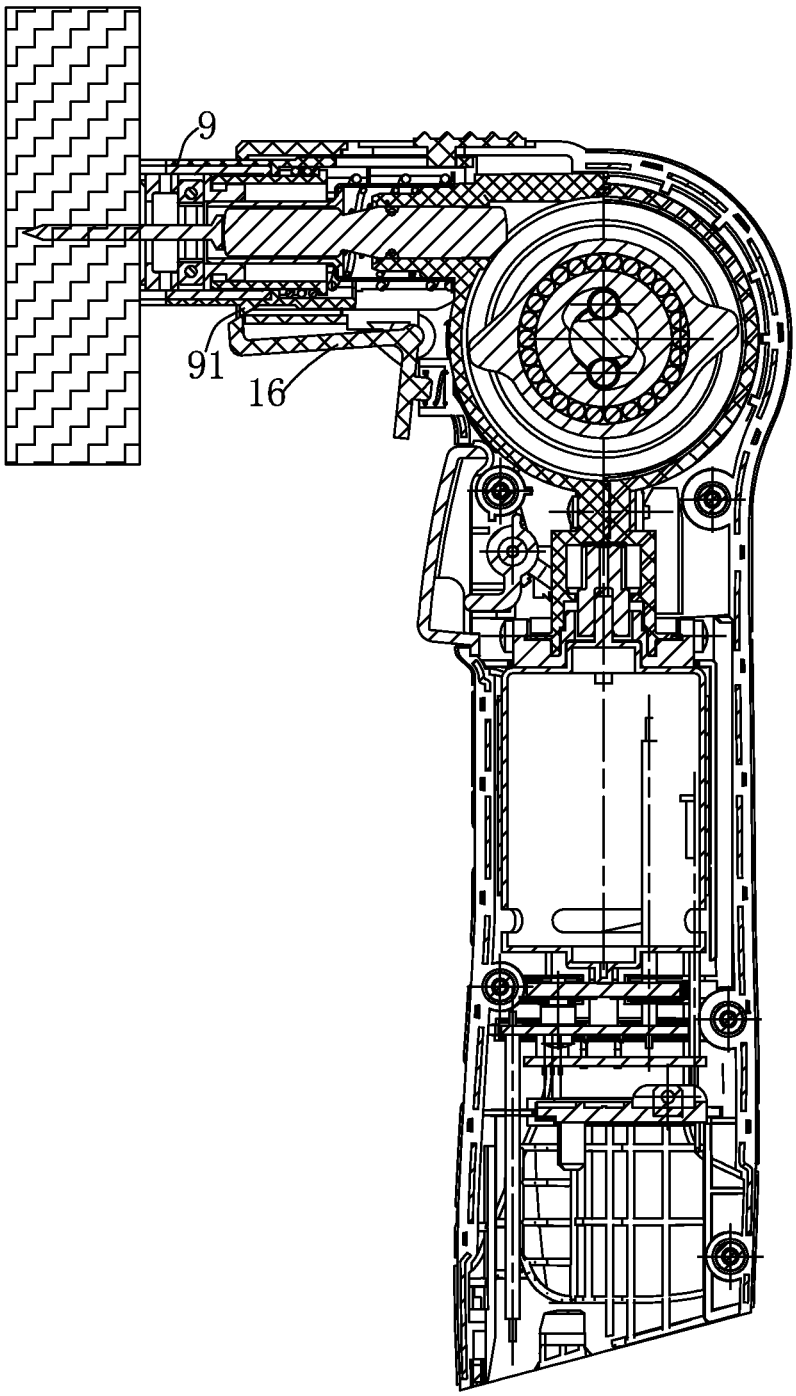
FIG. 11 is a schematic view illustrating the nail as being fastened into the workpiece and the projection on the sliding element of the electric hammer being pushed with the spanner open.
Figure 12:
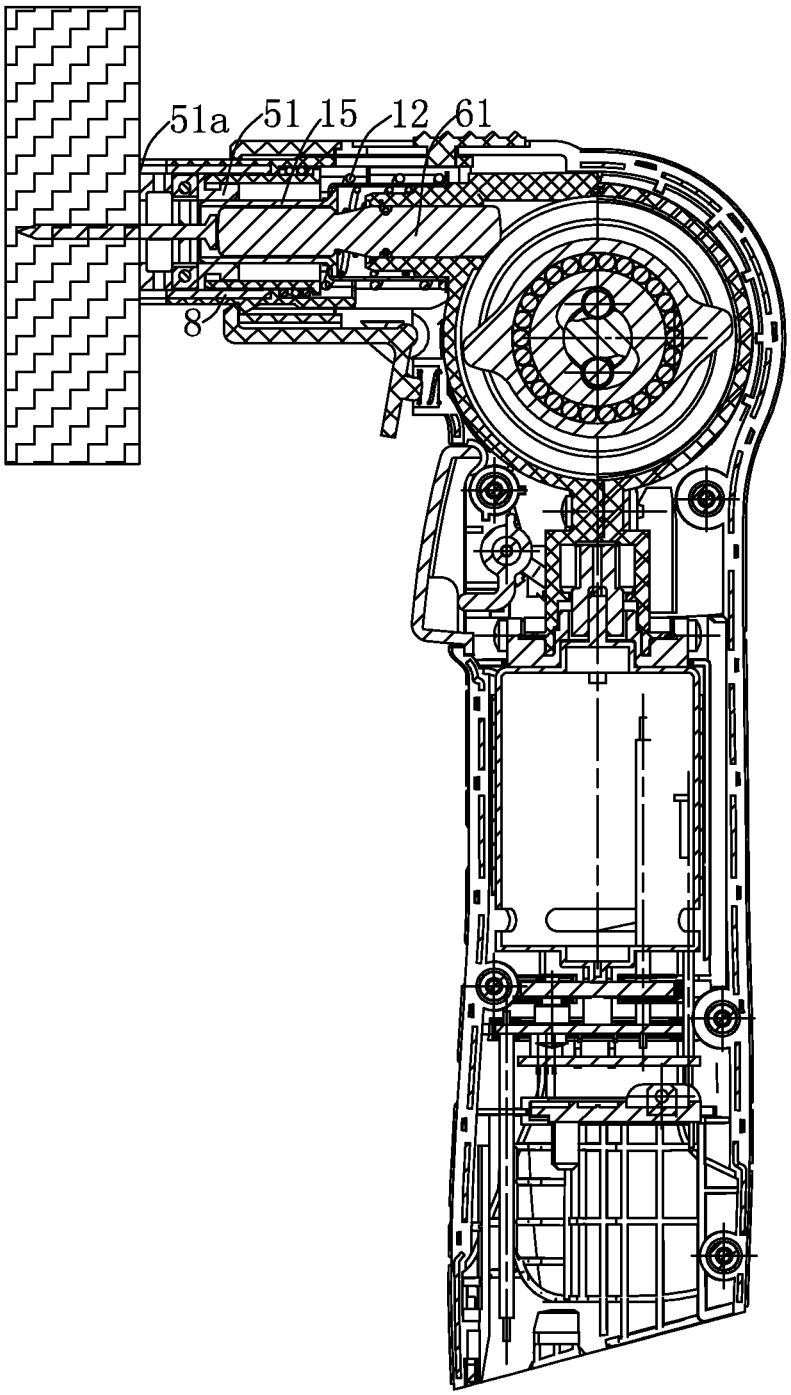
FIG. 12 is a schematic view illustrating the nail as being fastened into the workpiece and the body of the clamping mechanism of the electric hammer being in contact with the workpiece with the clamping element being in the completely opened position.

As shown in FIGS. 10-14, a biasing means is arranged between the clamping elements and the impact wheel 31. A first biasing means is provided in the form of a spring 11 for biasing the sliding element 8 leftward, namely, toward the direction of the striking element striking the component to enable the clamping elements to be located in the closed position. The spring 11 is arranged in such manner that one end thereof is mounted on the sliding element 8 and the other end thereof is mounted on the projection of the ferrule 10. When the sliding element 8 contacts with the workpiece, a biasing force of the first biasing means needs to be overcome so as to open the clamping elements. A second biasing means is provided in the form of a spring 12, which is used for biasing the ferrule 10 leftward. One end of the spring 12 is mounted on the ferrule 10 and the other end is mounted on a stop sleeve 13 so as to enable the ferrule 10, the body 51, and the clamping elements connected to the body 51 to be biased together toward the direction of the striking element striking the component. When the end surface 51 a of the body 51 contacts with the workpiece, the body 51 and the sliding element 8 overcome the biasing force of the second biasing means together and move. In another embodiment, the body 51 may also serve as a connecting piece. In this case, one end of the second biasing means 12 is mounted on the stop sleeve 13 and the other end thereof is mounted on the body 51 so as to enable the body 51 to be biased along with the clamping elements connected to the body 51 toward the direction of the striking element striking the component. A third biasing means is provided in the form of the spring 14, which is used for biasing a protective element 15 toward the direction of the striking element striking the component. One end of the spring 14 is mounted onto the gearbox and the other end thereof on the protective element 15. When the protective element 15 contacts with the workpiece, the protective element 15 overcomes the biasing force of the third biasing means along with the sliding element 8 and the ferrule 10 to move until the nail is fastened into the workpiece completely. During movement of the clamping elements from the closed position to the opened position, the biasing force of the first biasing means is smaller than that of the second biasing means. Hence, when the clamping elements are in the completely opened position, as shown in FIG. 12, the first biasing means 11 is compressed to the maximum and the generated biasing force is also maximum. At this time, the biasing force is still smaller than that of the second biasing means so that the ferrule 10 may not move along the reverse direction of the striking element striking the component to clamp the clamping elements again.

The above spring may be a compression spring or a helical spring. Certainly, one skilled in the art can also conceive that the spring may be substituted by other elastic biasing means or ones with attractive or repulsive forces, for example, the springs 11, 12 and 14 may be substituted for a magnetic element.

Figure 13:
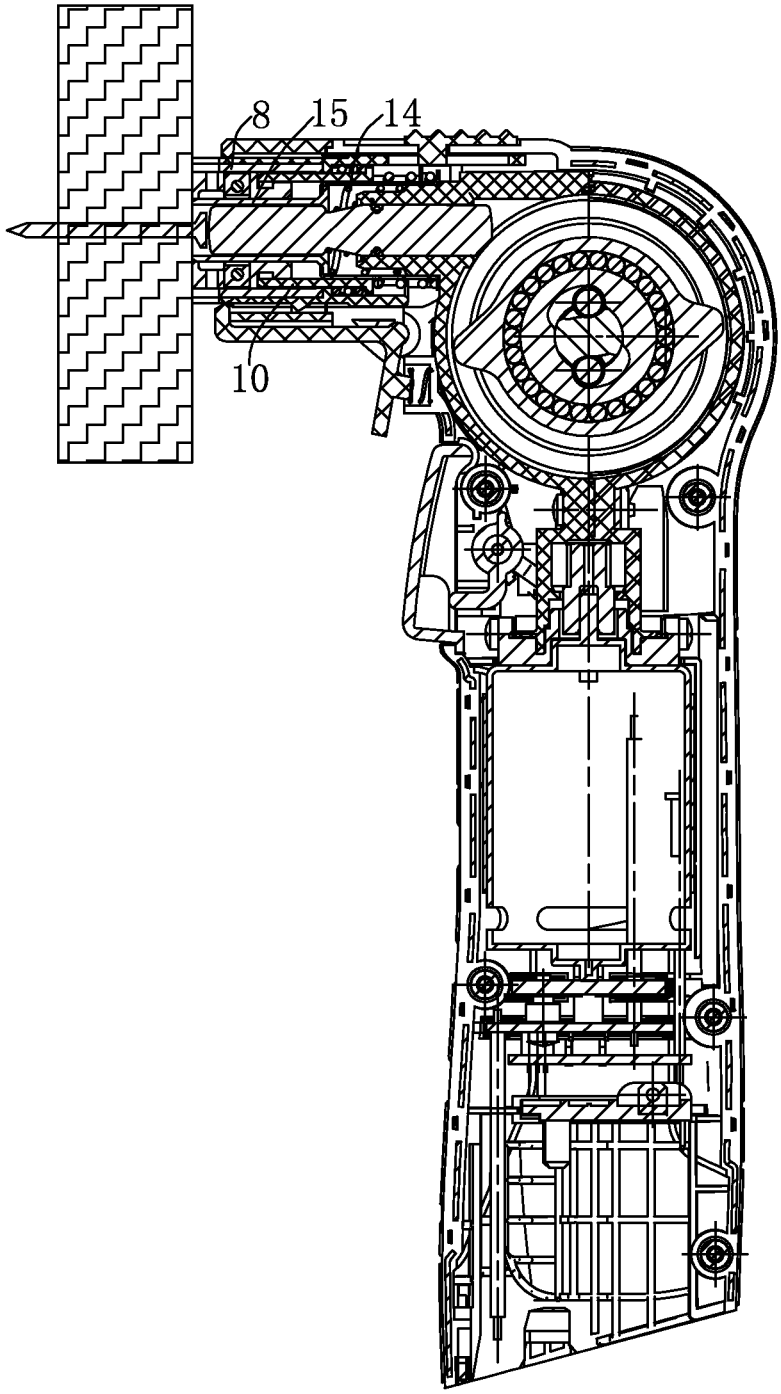
FIG. 13 is a schematic view illustrating the nail as being fastened into the workpiece and the protective element of the clamping mechanism of the electric hammer being in contact with the workpiece.
Figure 14:
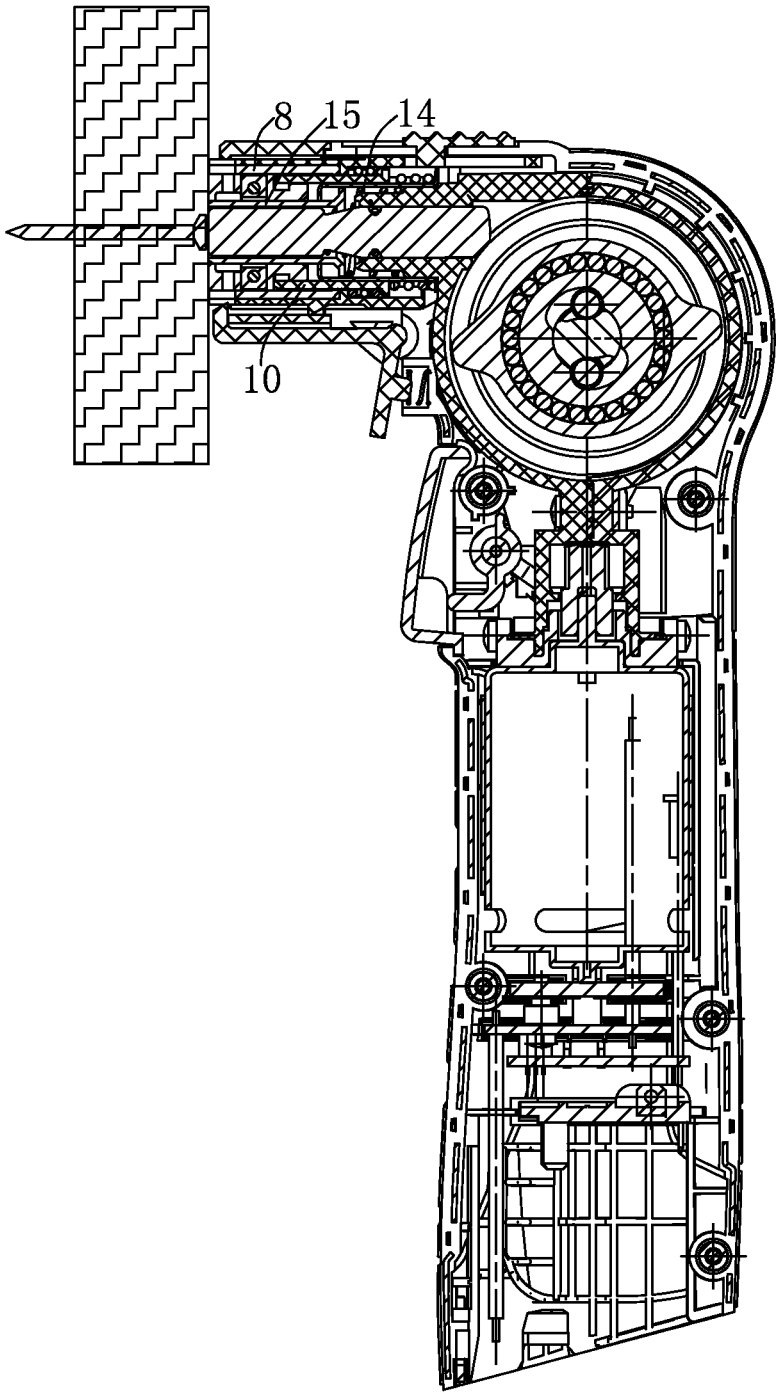
FIG. 14 is a schematic view illustrating the nail as being fastened into the workpiece completely.

During operation, if the clamping elements are in the closed position, as shown in FIG. 2, the pressure of the first biasing means 11 may be overcome by moving a toggle-switch 21 by the user so that the sliding element 8 is pushed to move rightward. The toggle-switch 21 is mounted on the housing 2 and engaged with the sheath 9. Through triggering the toggle-switch 21 rightward, the sliding element 8 and the sheath 9 are moved rightward or the sliding element 8 is directly pushed to move rightward. As long as a "click" is heard, the clamping elements are opened completely. At this time, the nail can be placed into the cavity 63. Then the spanner 16 is released to enable the nail to be retained by the clamping elements separately. Subsequently, the electric hammer is positioned to make the nail abut to the workpiece. Finally, the switch 7 is pressed down, after a battery assembly (not shown) is assembled, to actuate the motor M so as to cause the striking element 61 to move in reciprocating manner. When the electric hammer is pushed to press on the workpiece by the user, the head of the nail is struck by the striking element 61 in a reciprocating manner and accordingly the nail is fastened into the workpiece gradually. If the user wants to stop striking when the clamping elements are not opened, the user can trigger the toggle-switch 21 rightward to move it rightward along with the sliding element 8 or directly press the sliding element 8 to move rightward so as to enable the clamping elements to disengage with each other and accordingly to release the nail from the electric hammer. During the nail being fastened into the workpiece, as shown in FIG. 10, the compression force of the spring 11 needs to be overcome so as to open the clamping elements when the sliding element 8 is attached to the workpiece. This allows for the nail to be driven partially into the workpiece before being released. As shown in FIGS. 11 and 12, the sheath 9 comprises at least one projection 91 on its lower end. As the projection 91 pushes the spanner 16, the sheath 9 pushes away the projections 101 on both sides of the ferrule 10 from the housing so that the body 51 can slide toward into the housing. As shown in FIG. 12, when the end surface 51*a* of the body 51 contacts the workpiece, the clamping elements are in the completely opened position, the user needs to overcome the compression force of the spring 12 to cause the head of the nail to pass through the clamping elements, the protective element 15 and the impact element 61 may also continue to strike the nail via the clamping elements. As shown in FIG. 13, the protective element 15 is arranged in the periphery of the striking element 61, when the protective element 15 contacts the workpiece, the user needs to overcome the compression force of the spring 14 to enable the protective element 15 to be always around the head of the nail to prevent it from wheeling in the gap that is generated when the clamping elements are opened completely. As shown in FIG. 14, the nail is continued to be stricken until the nail is fastened into the workpiece entirely.

The clamping mechanism comprises a locking mechanism. After the nail is fastened into the workpiece entirely, the projection 91 engages the spanner 16 to lock the sheath 9 in the completely opened position of the clamping elements. The user then need only place another nail into the cavity 63 and press the spanner 16 to make the clamping elements clamp the nail within the cavity 63. Repeating the above steps can carry out the second cycle of strike. The sheath 9 can be further provided with another projection on its lower end to allow for locking the sheath 9 in another position where the protective element 15 is exposed from the sliding element 8 to enhance the visibility of the striking element 61. At this time, the striking end 611 of the striking element 61 can act as a beating portion. During operation, the workpiece to be processed such as a tenon or a brick to be stricken is contacted by the striking element 61 moving in a linear and reciprocating manner. Thus, the functions of the machine are expanded and accordingly not limited only to nailing a fastener into the workpiece. According to the present embodiment, it is appreciated for the skilled in the art that the sliding element 8 and the sheath 9 may be made from transparent material such as the transparent plastic, so as to enhance the visibility of the striking element 61. When the user observes the specific position of the striking element 61, he/she may use it as the electric hammer and strike the workpiece to be processed. Furthermore, when the nail clamped is smaller, the "V" shaped grooves arranged on the sliding element and the sheath may also enhance the visibility of the nail to facilitate the operation of the user.

The electric hammer disclosed by the present invention is not limited by the contents of the above embodiment and the structure illustrated by the drawings. Rather, changes, substitutions or the modifications to the shapes and the positions of the components described and illustrated herein are to be regarded as falling into the protective scope of the claims which follow.

What is claimed is:

1. An electric hammer, comprising:

a striking device having a clamping mechanism and an impact assembly;

the clamping mechanism comprising:

clamping elements; and a sliding element provided with a guiding portion in which is slidably retaining the clamping elements, wherein the clamping elements are slidable between a first position with respect to the guiding portion where the clamping element are closed and a second position with respect to the guiding portion where the clamping element are opened;

the impact assembly comprising:

a striking element having a first end defining an impact portion and a second end defining a striking portion; and an impact wheel;

a connecting piece connecting the clamping mechanism to the impact assembly;

a first biasing element to bias the sliding element away from the impact assembly to enable the clamping elements to be located in the closed position; and a second biasing element to bias the connecting piece away from the impact assembly, wherein the impact wheel contacts with the impact portion of the striking element, and the first biasing element and the second biasing element are positioned between the striking portion of the striking element and the impact wheel, and wherein a biasing force generated by the first biasing element is smaller than that of the second biasing element when the clamping element is in the opened position.

2. The electric hammer according to claim 1, wherein the electric hammer further comprises a motor and a transmission mechanism, wherein the motor defines an axis and the transmission mechanism converts the rotational motion of the motor into the impact motion for the striking element through the impact assembly, wherein the impact wheel defines a central axis, and wherein the axis of the motor is generally perpendicular to the central axis of the impact wheel.

3. The electric hammer according to claim 1, wherein the sliding element is provided with the guiding portion on at least two surfaces thereof and the clamping element comprises a driving portion wherein the driving portion is arranged in the guiding portion and can move along the guiding portion.

4. The electric hammer according to claim 3, wherein the clamping mechanism comprises four clamping elements, wherein the sliding element is provided with the guiding portions on four surfaces thereof, and wherein the driving portions of the clamping element are mounted in the guiding portion and can move along the guiding portion.

5. The electric hammer according to claim 3, wherein the driving portions are slots which are symmetrical to each other and are nonlinearly shaped.

6. The electric hammer according to claim 3, wherein the driving portions are removeably mounted on the clamping elements.

7. The electric hammer according to claim 3, wherein the driving portions and the clamping elements are integrally configured.

8. The electric hammer according to claim 1, wherein the clamping elements comprise at least one of a clamping jaw, a spring, a magnet, a screw, or a chuck.

9. The electric hammer according to claim 1, wherein a release area is formed when the clamping elements are located in the opened position and wherein the striking element is passable through the release area.

10. The electric hammer according to claim 9, wherein the clamping mechanism comprises a protective element which can pass through the release area.

11. The electric hammer according to claim 10, wherein the clamping mechanism comprises a third biasing element for biasing the protective element towards the direction of the workpiece to be processed.

12. The electric hammer according to claim 1, wherein the clamping elements can be interlocked.

13. The electric hammer according to claim 1, wherein the clamping mechanism comprises a locking mechanism.

14. The electric hammer according to claim 13, wherein the locking mechanism includes at least a projection and a spanner.

15. The electric hammer according to claim 14, wherein the clamping element is in the opened position when the projection is locked with the spanner.

16. The electric hammer according to claim 14, further comprising a protective element at least partially surrounding the sliding element, wherein the protective element is moveable to expose the sliding element when the projection is locked with said spanner.

17. The electric hammer according to claim 1, wherein the sliding element is provided with a sheath.

18. The electric hammer according to claim 17, wherein a toggle-switch is provided to engage with the sheath so as to enable the sheath to move along with the toggle-switch.

19. The electric hammer according to claim 17, wherein at least one of the sheath and the sliding element is made from a transparent plastic.

20. The electric hammer according to claim 17, wherein a groove is arranged on at least one of the sliding element and the sheath.

* * * * *